US006991346B2

(12) United States Patent
Saban et al.

(10) Patent No.: US 6,991,346 B2
(45) **Date of Patent: *Jan. 31, 2006**

(54) SIGNAL LIGHT FOR ATTRACTING DELIVERIES

(75) Inventors: Alex Saban, Blacksburg, VA (US); Ned F. Lafon, Lumberton, NJ (US)

(73) Assignee: Beacons LLC, Blacksburg, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/054,817

(22) Filed: Feb. 10, 2005

(65) Prior Publication Data

US 2005/0151666 A1 Jul. 14, 2005

Related U.S. Application Data

(63) Continuation of application No. 10/831,831, filed on Apr. 26, 2004, now Pat. No. 6,883,930.

(60) Provisional application No. 60/466,694, filed on Apr. 29, 2003.

(51) Int. Cl.
*F21L 4/00* (2006.01)

(52) U.S. Cl. ..... 362/200; 362/157; 340/815.45

(58) Field of Classification Search ..... 362/200, 362/157; 340/815.45
See application file for complete search history.

(56) References Cited

U.S. PATENT DOCUMENTS 4,161,015 A 7/1979 Dey et al.
4,161,018 A * 7/1979 Briggs et al. ..... 362/104
4,611,265 A 9/1986 Davis
4,686,505 A 8/1987 Vanderburg
4,839,630 A 6/1989 Miller
5,103,581 A 4/1992 Novak
5,893,626 A 4/1999 Poling
6,000,811 A 12/1999 Bordak
6,098,326 A 8/2000 Campbell, III
6,530,679 B1 * 3/2003 Nishioka ..... 362/339
6,533,436 B2 * 3/2003 Krietzman et al. ..... 362/200
2002/0070929 A1 6/2002 Hunter

* cited by examiner

*Primary Examiner*—Thomas M. Sember
*Assistant Examiner*—James W Cranson, Jr.
(74) *Attorney, Agent, or Firm*—Craig A. Fieschko, Esq.; DeWitt Ross & Stevens S.C.

(57) ABSTRACT

A compact signal light is provided with LEDs arrayed across its front face, and a magnet and/or suction cup on its rear face so that a user may readily mount it on a refrigerator door or the like. The front face of the signal light may bear the name and telephone number of a delivery or emergency service so that a user may resort to the signal light when making an emergency or delivery call. The user may then turn on the signal light so that its LEDs are illuminated (with one or more of the LEDs preferably flashing), and place the signal light on a door or window where the delivery or emergency service is to be rendered, so that the location is more easily found by the delivery or emergency personnel without "hunting." The signal light provides a particularly valuable tool for pizza delivery companies and the like because it serves as an advertising tool reminding the consumer of the company, as well as providing the company with a way to more quickly and efficiently render its delivery services.

34 Claims, 2 Drawing Sheets

SIGNAL LIGHT FOR ATTRACTING DELIVERIES

CROSS-REFERENCE TO RELATED APPLICATIONS

This application is a continuation under 35 USC § 120 of U.S. patent application Ser. No. 10/831,831 filed 26 Apr. 2004, now U.S. Pat. No. 6,883,930 which in turn claims priority under 35 USC § 119(e) to U.S. Provisional Patent Application No. 60/466,694 filed 29 Apr. 2003. The entireties of these prior applications are incorporated by reference herein.

FIELD OF THE INVENTION

This document concerns an invention relating generally to signal lights, and more specifically to signal lights for use at residences and businesses to indicate to delivery, emergency, or other vehicles on adjacent roadways that service is needed at a particular location.

BACKGROUND OF THE INVENTION

Signal lights are often used to indicate to observers the location of the signal light user. One particular application of signal lights is to indicate to delivery or emergency vehicles a particular address or location at which a delivery is to be made, or at which emergency services are to be rendered. Such lights are useful since it may be difficult for delivery or emergency personnel to locate a specific address for a residence or business, particularly in low light conditions where the personnel are in a hurry, and where addresses may not be prominently posted at a location. A summary of several prior signal lights which were specifically designed to attract delivery or emergency personnel follows.

U.S. Pat. No. 5,103,581 to Novak describes a signal light (a "delivery alert apparatus") which is intended to be turned on and visibly placed outside a location where a delivery is to be made (e.g., a pizza delivery), so that the delivery personnel can more rapidly identify to where the delivery is to be made. As detailed in column 3 of the patent, the device has a casing in the form of a thick disc with a hanging strap/loop at its top. When a switch on the rear of the casing is activated, batteries illuminate a bulb within the casing. The bulb transmits its light through fiberoptic cables having terminal ends arrayed through apertures in the front face of the casing to form letters. Thus, for example, the front face of the device's casing could display illuminated letters spelling the message "PIZZA BUDDY."

U.S. Pat. No. 6,098,326 to Campbell describes a signal light for drawing attention to a location for deliveries, emergencies, and the like. The device has an elongated box-like casing which may be hung at its top from a hanging strap/loop (see FIG. 2), and a translucent front sign panel (which may bear an opaque message thereon) is inserted into a slot at the front of the casing to define its front surface (see column 4 lines 30–50). The sign panel is interchangeable with other sign panels bearing different messages. Incandescent lights within the casing illuminate the sign panel from its rear when powered from a power cord, and a switch on the casing allows a user to set the lights in constantly on, blinking, and off modes (column 4 lines 9–18). Light is also projected through holes in the top of the casing (column 3 lines 16–26).

U.S. Pat. No. 4,686,505 Vanderburg describes a signal light similar to the one of Campbell (discussed above), but here the casing has two compartments, one bearing the sign panel at its front (with the sign panel bearing address numbers), and the other containing a strobe light which flashes adjacent the sign panel (see FIG. 1). The device bears slotted holes on the rear of the casing so that fasteners protruding from a building may be inserted therein to support the casing (column 2 lines 40–45). While the strobe and sign panel lights are described as being powered by a cord, batteries are also contemplated (column 3 lines 6–8).

U.S. Patent Application Publication 2002/0070929 to Hunter describes a signal light similar to the one of Vanderburg (discussed above), but as shown in FIG. 1 and described at paragraphs 0014–0015, the front sign panel (which may bear a message such as "HELP") is intended to flash, and rotating or flashing dome lights are also provided atop the casing. A siren may also be provided on the device (paragraph 0005). The device is intended to be actuated by a wireless signal, which may selectively activate one or more of the siren, the front sign panel illumination, and/or the dome lights (paragraph 0017). The device can be mounted on a wall of a building, or on a pole (paragraph 0013, 0016).

U.S. Pat. No. 4,611,265 to Davis describes a lighted address display including a flashing emergency signal light. The display has an elongated box-like casing with a translucent face plate, with address numbers/letters being formed of opaque material and being applied to the face plate (column 3 lines 25–27). As illustrated in FIG. 4, one bulb within the casing is activated by a photocell during low light conditions, and the flashing bulb within the casing may be activated by a remote switch, which may be a wireless switch (column 3 lines 37–42).

U.S. Pat. No. 4,839,630 to Miller describes an emergency signal light which is provided in accompaniment with a loud horn, and which can be mounted on a wall (column 3 lines 15–29). Power is provided by standard household current or by batteries pack (column 3 lines 24–26, column 5 lines 3–8). Referring to FIG. 2, the light/horn can be activated by pushing a switch 88 situated at the end of an extension cord 9, with the switch having an adjacent LED 91 which indicates when the light/horn are activated. Activation of the switch can also complete a phone dialing circuit to dial an emergency number (column 4 line 60 onward). The light may be made to flash if desired (column 5 lines 46–49).

U.S. Pat. No. 6,000,811 to Bordak describes a portable signal light for signaling home or roadway emergencies having a generally cylindrical casing with red and white flashing lights at its opposite ends (FIG. 1, column 2 lines 55–63). A hanging strap/loop is provided to allow the signal light to be hung on a doorknob or the like (column 3 lines 54–59). Each light is powered by one or more batteries within the casing, and is activated by its own independent switch (column 3 lines 12–31).

There also signal lights designed for other applications. As an example, U.S. Pat. No. 5,893,626 to Poling describes a signal light which is suitable for attachment to a bicycle or other vehicle. The light includes a casing which contains batteries (though attachments to external power supplies may be used, column 3 lines 57–60), and a switch on the casing powers lights situated behind a transparent face on the casing (column 4 lines 2–6). The lights, which are arranged in concentric rings and which may be provided in different colors, may be incandescent bulbs or LEDs (column 4 lines 5–37). The central light may be on constantly or may blink (column 4 lines 38–49), whereas the outer rings of lights may sequentially illuminate in a circular pattern, but with each ring illuminating in an opposite direction (column 4 lines 50–67). Two versions of the signal light are illustrated, one being of a cylindrical shape conventional for bicycles and similar vehicles (FIG. 1) and which may be attached to a vehicle by use of a bracket, straps, magnets, or other arrangements (column 3 lines 61–65), and the other being of a disc-like shape (FIG. 5) which is intended to be worn by a user by use of a wrist strap, neck cord, or the like (column 5 line 53-column 6 line 6).

Despite the prior work in the field of signal lights for attracting delivery or emergency personnel, such signal lights are rarely used owing to certain deficiencies. Initially, they are often not very visible, and therefore are not very effective. As an example, devices such as U.S. Pat. No. 5,103,581 to Novak—wherein some particular message is illuminated—are often ineffective since the signal light is observed from such a distance that the characters of the message appear as an illuminated blur. In effect, from a distance, the message simply appears as a unitary light, which is indistinguishable from a common house, business, vehicle, or street light. Flashing lights can help make a signal light more distinctive with respect to lights commonly encountered in the surrounding environment, but even these can be difficult to differentiate from flashing vehicle or business lights. Low frequency flashing may also be unnoticeable to delivery or emergency personnel who are in a hurry, since they may only glance at the area where the signal light is located, and do so when the light is either on or off, in effect causing the personnel to miss the fact that the light is flashing.

Additionally, cost, maintenance, and installation issues have precluded the wide use of signal lights. Several of the aforementioned signal lights are bulky and expensive, and require hardwiring or other significant installation steps such that the burdens of their installation and use outweigh their benefits. Other signal lights are designed to be portable self-contained units having battery-based power supplies, but even these tend to be so bulky and expensive that most consumers do not regard them as being worthwhile to obtain, particularly since they are generally not used on a frequent basis. Many consumers find it difficult to store a flashlight in a convenient, ready-to-use location, and since the prior signal lights effectively constitute special-use flashlights (generally of large size), most consumers simply don't care to purchase and store the prior signal lights: they represent a rarely-used piece of electronic equipment which is simply not worth the storage space that it occupies. The signal lights are also inconvenient to maintain, particularly where they use common incandescent bulbs and standard A, C, or D-cell batteries. Incandescent lights rapidly consume power and require frequent battery replacement, which is particularly true where the incandescent lights flash (which also tends to cause rapid bulb deterioration and the need for frequent bulb replacement).

SUMMARY OF THE INVENTION

The invention, which is defined by the claims set forth at the end of this document, is directed to a signal light which is intended to at least partially solve the aforementioned problems, and to provide advantageous features which are not present in the aforementioned signal lights. To give the reader a basic understanding of some of the advantageous features of the invention, following is a brief summary of a preferred version of the signal light, which will be discussed with reference to the accompanying drawings. As this is merely a summary, it should be understood that more details regarding the preferred version may be found in the Detailed Description set forth elsewhere in this document. The claims set forth at the end of this document then define the various versions of the invention in which exclusive rights are secured.

Referring particularly to FIGS. 1 and 2 of the drawings, the signal light 100 includes a casing 102 having a front face 104 (FIG. 1), an opposing rear face 106 (FIG. 2) oriented at least substantially parallel to the front face 104, and sidewalls 108, 110, 112, and 114 extending therebetween. These sidewalls include a top sidewall 108 (FIG. 3) and an opposing bottom sidewall 110 (FIGS. 1 and 2) between which the height of the casing 102 is measured, and a right sidewall 112 (FIG. 1) and opposing left sidewall 114 (FIG. 2) between which the width of the casing 102 is measured. The thickness dimension of the casing 102 is measured between the front and rear faces 104 and 106. As will be discussed at greater length below, the storage concerns of prior signal lights may be largely avoided by giving the casing 102 a thickness of less than approximately 0.75 inches, and a front face 104 area of less than approximately 8 square inches, and then providing at least one of a suction cup 116 and a magnet 118 on the rear face 106 of the casing 102 (see FIG. 3). With this preferred sizing and these preferred means for mounting the signal light 100 to a door or other surface, the signal light 100 can be readily stored on a vertical surface such as a refrigerator door so that it may be pulled off for easy use, without the signal light 100 protruding overmuch from the refrigerator (or occupying drawer or counter space that might be better used for other purposes). Since the signal light 100 is essentially the same size as (or only slightly larger than) a commonly encountered refrigerator magnet—an item which is usually situated on a vertical surface (such as a refrigerator door) which has limited use for storage purposes—the signal light 100 is more readily stored and accessed than prior signal lights, and does not occupy storage space that is preferably used for other purposes.

Two or more (and preferably three or more) light-emitting diodes (LEDs) 120*a*, 120*b*, and 120*c* (collectively referred to herein as LEDs 120) are then spaced about the front face 104 of the casing 102 to provide a light signal to delivery or emergency personnel when the signal light 100 is placed outside a service location. As will be discussed at greater length below, suitable LEDs 120 provide extremely high light output—potentially visible over a mile away—with extremely low power draw, thereby diminishing concerns regarding battery and light consumption and replacement. At least some of the LEDs 120 are preferably substantially spaced apart across the front face 104 of the casing 102, e.g., by a distance at least as great as approximately one-half of the greater of the width or height dimensions of the casing 102. With this spacing, owing to the brightness of LEDs, the spaced LEDs 120 will still appear as individual point light sources when viewed from standard road-to-residence distances. This helps a viewer differentiate the signal light 100 from a standard residential, business, or vehicle light since it appears as a distinctive set of closely-spaced point sources of light. When viewed at greater distances, the LEDs 120 may "blend" and appear as a single light source, but as discussed below, by making at least one of the LEDs 120 flash, the light of the flashing LED will add to (and then subtract from) any other light transmitted from the signal light 100, thereby also helping a viewer distinguish the signal light 100 from other common light sources.

The LEDs 120 are powered by a powering circuit (depicted as a circuit board 122 in FIG. 3) which supplies the LEDs 120 with power from one or more batteries 124 (FIG.

3) when a switch 126 (FIG. 2) is actuated. The powering circuit 122 preferably causes at least one of the LEDs 120 to be illuminated at a frequency of greater than 0.5 Hz when the switch 126 is actuated, with the flashing of the LED(s) thereby helping a viewer better distinguish the signal light 100 from other "static" ambient nonflashing lights (e.g., a common house light). The distinctiveness of the emitted light is believed to be enhanced where three or more LEDs 120 are used on the signal light 100, and wherein at least one of the LEDs 120 does not rest along a line defined by two of the other LEDs 120 (i.e., the LEDs 120 are not all oriented along a straight line, and are "scattered" to some degree). When the LEDs 120 are arrayed in this fashion with at least one of them flashing, the signal light 100 emits a distinctive light pattern at standard road-to-residence distances which does not appear as a unitary light (in contrast to the situation where all lights are statically lit along a straight-line array); rather, a cluster of point light sources is seen, with at least one of them flashing, a pattern which is uncommon in commonly encountered lights such as residential/business lights, vehicle lights, and the like. The emitted light becomes even more distinctive where two or more of the LEDs 120 are lit at different times (for example, where the LEDs 120 shown in FIG. 1 are sequentially flashed in clockwise order). When this is done, it is possible to distinguish between different LEDs 120, and different flash patterns, at standard road-to-residence distances. Stated differently, as an example, if the LEDs 120 shown in FIG. 1 are sequentially flashed in clockwise order, they will appear (at standard road-to-residence distances) as separate spaced lights rather than as one single light: since LEDs 120 have great brightness, one can tell when one LED is turned off and an adjacent LED is turned on even at significant distances. Even when one LED is turned on at the same time as an adjacent LED, they do not "blur together" to a viewer because the additive/subtractive effect on light output when one LED is turned on or off allows a viewer to tell that more than one LED is present.

The foregoing feature beneficially allows the signal light 100 to effectively send a distinctive signal to a distinct delivery company or emergency service—for example, the signal light 100 can be configured to have the LEDs 120 flash sequentially clockwise for a certain pizza delivery company, or to have the LED 120*a* stay on constantly while LEDs 120*b* and 120*c* sequentially flash for a certain video/entertainment media delivery company, or to have LEDS 120*a* and 120*b* first simultaneously illuminate followed by simultaneous illumination of LEDs 120*b* and 120*c* for a certain paramedic service, etc. Since each of these unique illumination "signatures" may be differentiated by an observer at standard road-to-residence distances, and since each different delivery/emergency concern can be trained to recognize its own distinct illumination signature, the signal light 100 can serve to indicate to a particular concern that service is expected at the location where the signal light 100 is viewed, even if there is significant surrounding "noise" from ambient residential, business, and vehicle lights. Further, even if multiple addresses along the same street each use the signal light 100—for example, if one residence uses the signal light 100 to signal to one pizza delivery company that a pizza is expected, and another residence uses the signal light 100 to signal to another pizza delivery company that its pizza is expected—the delivery companies will not be misdirected to the wrong address since they can each recognize the unique illumination signature chosen by that company.

The signal light 100 provides an especially inexpensive, convenient, and effective means for service providers to allow their consumers to contact them for service, and then signal to the providers where the service is to be made. Since the signal light 100 can be inexpensively manufactured, a service provider may provide the signal light 100 to its consumers at low or no cost. The front face 104 of the casing 102 may provide a fairly significant area upon which indicia may be printed—again note FIG. 1, which shows an exemplary signal light 100 at or near the size at which the signal light 100 may actually be provided—and thus the front face 104 may bear the name and telephone number of a particular service (for example, "ALEX'S PIZZA" followed by a phone number). A consumer may therefore (for example) look to the signal light 100 when mounted on a refrigerator, make a service call, and then place the signal light 100 on or adjacent to the consumer's door to allow the service's personnel to more rapidly identify the delivery location and effect delivery. Since the unit cost of the signal light 100 can increase if each service provider must have an individually-designed powering circuit 122 providing that concern's own individual illumination pattern or "signature," the powering circuit 122 for the signal light 100 preferably includes reconfiguration means allowing the illumination pattern of the LEDs 120 to be individually programmed for an individual service provider, whereby the reconfiguration means can be easily reconfigured to provide one unique illumination signature for one service provider and another unique illumination signature for another service provider, while both providers still use essentially the same signal light structure. This is most preferably done by including a chip (e.g., a microcontroller) with an electronic memory onto which the illumination instructions for the LEDs 120 can be loaded. Thus, the manufacturer of the signal light 100 may readily format it with a unique illumination signature for each different service provider by simply loading the desired signature for that service provider into the memory provided on the powering circuit 122.

As previously noted, the signal light 100 is preferably easily mountable on a common vertical household surface such as a refrigerator door, and it is also preferably easily mountable to a window or door on the exterior of a delivery location. A particularly preferred mounting arrangement is best seen in FIG. 2, wherein it is seen that the rear face 106 of the casing 102 includes both a magnet 118 and a suction cup 116. The suction cup 116 is flexible, and it protrudes outwardly from the casing 102 past the magnet 118. As a result, the suction cup 116 may be pressed against a surface to engage the surface, provided it is a smooth and nonporous surface. Such compression of the suction cup 116 brings the magnet 118 into close proximity with the surface, and thereby allows the signal light 100 to cling to a magnetic surface even if the suction cup 116 will not do so. Such an arrangement allows the signal light 100 to firmly mount to a refrigerator, since the exteriors of most refrigerators are both smooth and magnetic, whereby both the magnet 118 and suction cup 116 will hold the signal light 100 to the refrigerator. However, the signal light 100 also preferably bears a lanyard 128 from which a hanging loop/strap may extend (if desired), allowing a hanging loop to be used where the signal light 100 is to be mounted at locations where no smooth and/or magnetic surfaces are available (e.g., allowing the signal light 100 to be hung about the door handle of a rough wooden door).

Further advantages, features, and objects of the invention will be apparent from the following detailed description of the invention in conjunction with the associated drawings.

DETAILED DESCRIPTION OF PREFERRED EMBODIMENTS OF THE INVENTION

Figure 2:
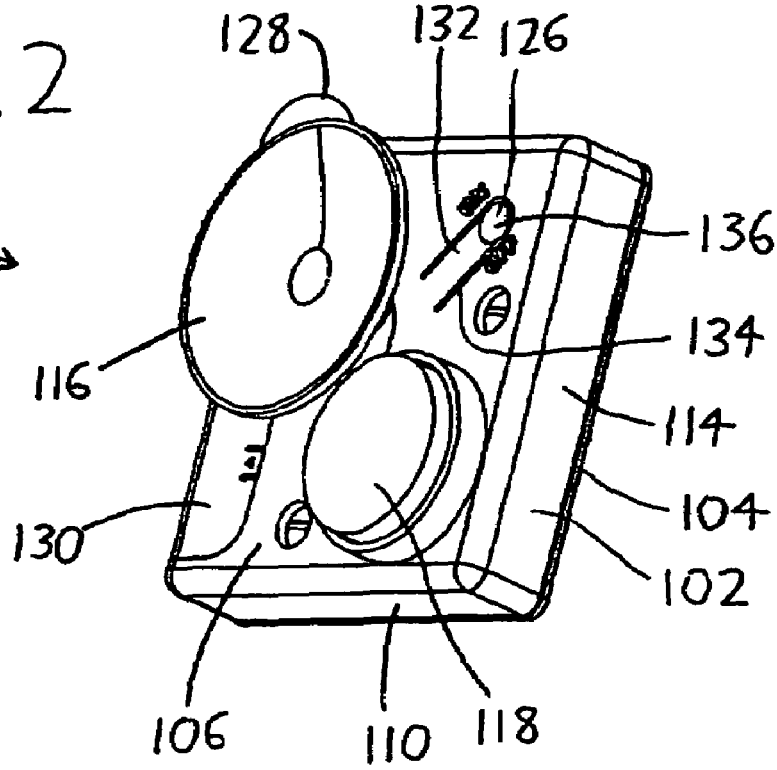
FIG. 2 is a rear perspective view of the signal light 100.

Referring again to the drawings for further details regarding the preferred version of the invention summarized above, the structure shown on the rear face 106 of the casing 102 (in FIG. 2) will now be discussed in greater detail. A battery compartment door 130 allows installation of and access to the batteries 124 (FIG. 3), which are preferably one or more button cell batteries. As used throughout this document, the term "button cell batteries" should be construed as meaning that class of batteries which are generally used for watches, hearing aids, and other small electronic items. Such batteries are generally coin- or button-shaped, and have terminals which are circumferentially spaced from each other, or are otherwise spaced from each other on opposing top and bottom sides of the battery by a distance smaller than the diameter of the battery. Such batteries are useful because they have extremely low size and weight, but still supply ample power for the powering circuit 122 and LEDs 120. The button cell batteries 124 are preferably installed so that each has its terminals oriented in a plane at least substantially parallel to the front face 104 of the casing 102 (i.e., the planes of the batteries 124 are substantially parallel to the plane of the casing 102), thereby helping to minimize the thickness of the casing 102.

As previously noted, the casing 102 preferably has a thickness of less than 0.75 inches, and it can easily be made with a thickness of 0.25 inches or less. While the signal light 100 is still useful if its casing 102 must be thicker, it begins to grow impractical for mounting on a refrigerator or other indoor vertical surface if it is thicker than 0.75 inches since it begins to excessively protrude. In any event, it is desirable to have the thickness of the casing 102 define its smallest dimension, and preferably the casing 102 has a thickness which is (at most) less than or equal to half of the greater of its width or height.

The rear face 106 of the casing 102 also includes a switch 126, which is usefully and inexpensively provided as a tongue 132 defined on the rear face 106 by an elongated U-shaped cutout 134, with a raised button 136 defined at the end of the tongue 132. When the casing 102 is formed of thin plastic, the tongue 132 is sufficiently flexible that depression of the button 136 allows the tongue 132 to flex inwardly to depress a powering circuit switch 138 (FIG. 3) situated on the powering circuit 122. Such an arrangement helps to better shield the powering circuit 122 and its powering circuit switch 138 from the environment (as opposed to, for example, defining an aperture in the casing 102 into which a user must reach to actuate the powering circuit switch 138), while still allowing easy actuation of the powering circuit switch 138.

The LEDs 120 used in the preferred version have a water clear lens, a peak wavelength of 625–630 nm (i.e., red illumination), and an on-axis luminous intensity of 2000±100 millicandela (at 20 mA current, 2.1±0.2 V) with a viewing angle of 50 degrees. Such LEDs are visible for nearly a mile in clear low-light conditions, and are readily visible for ⅛ mile (which is greater than standard road-to-residence distance) in conditions of poor visibility (e.g., in lighted or dim conditions, in fog or snow, etc.). Other colors and intensities are possible, and LEDs 120 with different specifications (e.g., LEDs of different colors) may be used on the same signal light 100. Red or amber light is preferred because the human eye has greatest light sensitivity near the red and amber wavelengths, and red LEDs presently have relatively low cost. Use of LEDs with different specifications (different colors, etc.) can lead to increased costs owing to the need for different components with potentially different power requirements, and is believed to be unnecessary since the signal light 100 works very well in providing a distinctive illumination signature at standard road-to-residence distances even without the use of LEDs having different specifications.

As previously noted, the powering circuit 122 preferably includes reconfiguration means for allowing a change in the frequency at which at least one of the LEDs 120 is illuminated, thereby allowing the signal light 100 to be readily "programmed" to provide a lighting scheme which is unique to a particular provider of delivery or emergency services. In the preferred signal light 100, the reconfiguration means takes the form of a PIC (Programmable Interface Controller) microcontroller—sometimes referred to as a "single-chip computer"—which may be reconfigured to provide different switching schemes for different LEDs 120 by installing a different code in its ROM. Such PICs, which are available from Microchip Technology, Inc. (Chandler, Ariz., USA), among others, are useful reconfiguration means because of their small size and weight, relatively low cost, low power draw (on the order of 50 mW), and easy reprogrammability. Other reconfiguration means might take the form of a switch on the powering circuit 122, or a bridge (i.e., a shorting conductor) which can be inserted or removed/broken, which reconfigures the powering circuit 122 to change the frequency at which at least one of the LEDs 120 is powered. It should be understood that the on/off switch 126 is not regarded as being a reconfiguration means; while it might be regarded as changing the illumination frequency from a "no frequency" state (when the switch 126 is off) to some frequency (from high-frequency strobing to perhaps a constantly on frequency), the "off" state is not considered. Stated differently, the reconfiguration means is capable of effecting a change in frequency when the on/off switch 126 is in its "on" state and the powering circuit 122 is powered.

An exemplary method for using the signal light 100 will now be described. When a delivery service—for example, a pizza delivery service—wishes to use the signal light 100 when it renders its services, it may contact a manufacturer for the signal light 100 and place an order for some number of signal lights, and request that a desired illumination signature (LED "blink pattern") be installed in each signal light 100. The manufacturer may then adjust the PIC or other reconfiguration means to provide the desired illumination signature, and then provide the programmed signal lights to the service provider. Either the manufacturer or service provider may then place desired indicia on the front face 104 of the signal light 100, e.g., a decal bearing the name of the service provider (such as "ALEX'S PIZZA") and its telephone number and hours of operation.

The service provider may then provide the signal light 100 to its consumers, for example, it can provide it to consumers during the course of one delivery for use during a subsequent delivery. It is notable that since the signal light 100 may be readily mounted on a refrigerator door or the like where it can be readily and frequently viewed, and it occupies little or no useful space, consumers are less likely to discard or lose the signal light 100. This is particularly true since many households are accustomed to common commercial refrigerator magnets bearing the names and numbers of businesses and emergency services (since many businesses and emergency services provide such magnets free of charge to consumers). Thus, the signal light 100 does not require that a consumer learn substantially new behavior when receiving the signal light 100. It is also notable that since the signal light 100 would usually be mounted by consumers on a refrigerator door, the signal light 100 provides a particularly valuable promotion tool for food delivery services (e.g., pizza parlors) since consumers will view the signal light 100 when hungry, and are more likely to make future purchases. When a consumer calls to request delivery service, the consumer can be asked by the service whether the consumer has a signal light 100. If the consumer does have a signal light 100, the consumer can be requested to place the signal light 100 on an exterior door or window, or other location visible from the road. If the consumer does not have a signal light 100, the service provider can provide the signal light 100 when making the delivery so that the consumer has the signal light 100 available for subsequent orders and deliveries.

After making a request for service, the consumer can then press the switch 126 to activate the signal light 100 and install it at a visible location. Service personnel can then more rapidly locate the service location by looking for the service provider's unique illumination signature. This is a useful feature because there has been increased pressure on delivery and emergency personnel to provide more rapid service over expanded areas, while at the same time avoiding speeding or other safety violations. By use of the signal light 100, personnel can reduce the problem of "hunting," i.e., driving about the area until the proper service location is finally identified. This increases the possibility that emergency personnel can more timely meet an emergency call, that food delivery personnel can ensure delivery of a fresh and/or hot product, or that other delivery personnel can better enhance customer satisfaction. When the delivery arrives, the consumer or delivery personnel can remove the signal light 100, turn it off, and place it on a refrigerator or other storage location for future use.

It should be understood that a preferred version of the signal light 100 claimed below has been shown and described to enhance the reader's understanding, and to illustrate preferred features of the signal light 100. However, the signal light 100 is not intended to be limited to the preferred version described above, but rather is intended to be limited only by the claims set out below. Thus, the invention encompasses all different versions of the signal light 100 that fall literally or equivalently within the scope of the claims. Following are examples of several possible modifications to the signal light 100 which may be readily implemented.

Figure 1:
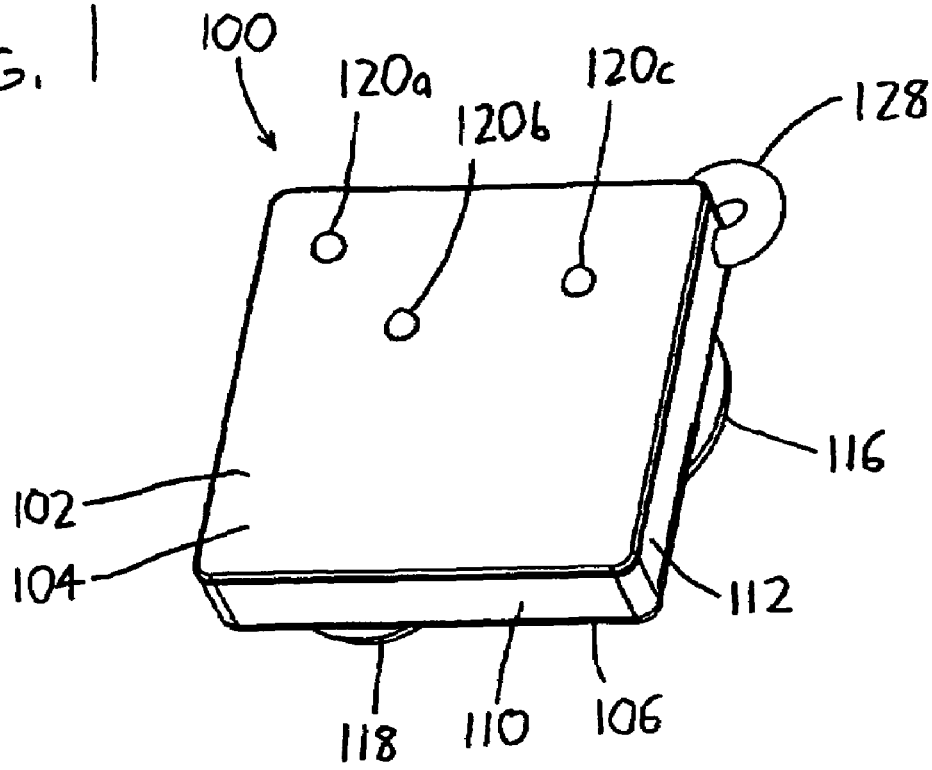
FIG. 1 is a front perspective view of a preferred version of the signal light, depicted generally by the reference numeral 100.

First, the signal light 100 is not limited to three red LEDs 120 situated in the triangular array shown in FIG. 1, and it is expected that different numbers, types, and configurations of LEDs 120 might be installed in the signal light 100. The preferred version of the invention merely includes three red LEDs 120 because this arrangement has been found suitable to allow transmission of a unique illumination signature at standard road-to-residence distances, while still allowing a unit manufacturing cost which allows a service provider to economically give away signal lights to consumers. However, the use of more and differently-colored LEDs 120 is possible, and will become more feasible if LEDs 120 experience price decreases. In this respect, note that other solid-state illumination devices are possible apart from LEDs 120 (e.g., laser diodes), and the term LED should be regarded as encompassing such solid state illuminators. While solid-state illuminators apart from LEDs 120 are currently cost-prohibitive for use in the signal light 100 if a service provider is to give signal lights away at minimal cost, other forms of illuminators may grow more feasible in the future if price decreases occur.

Figure 3:
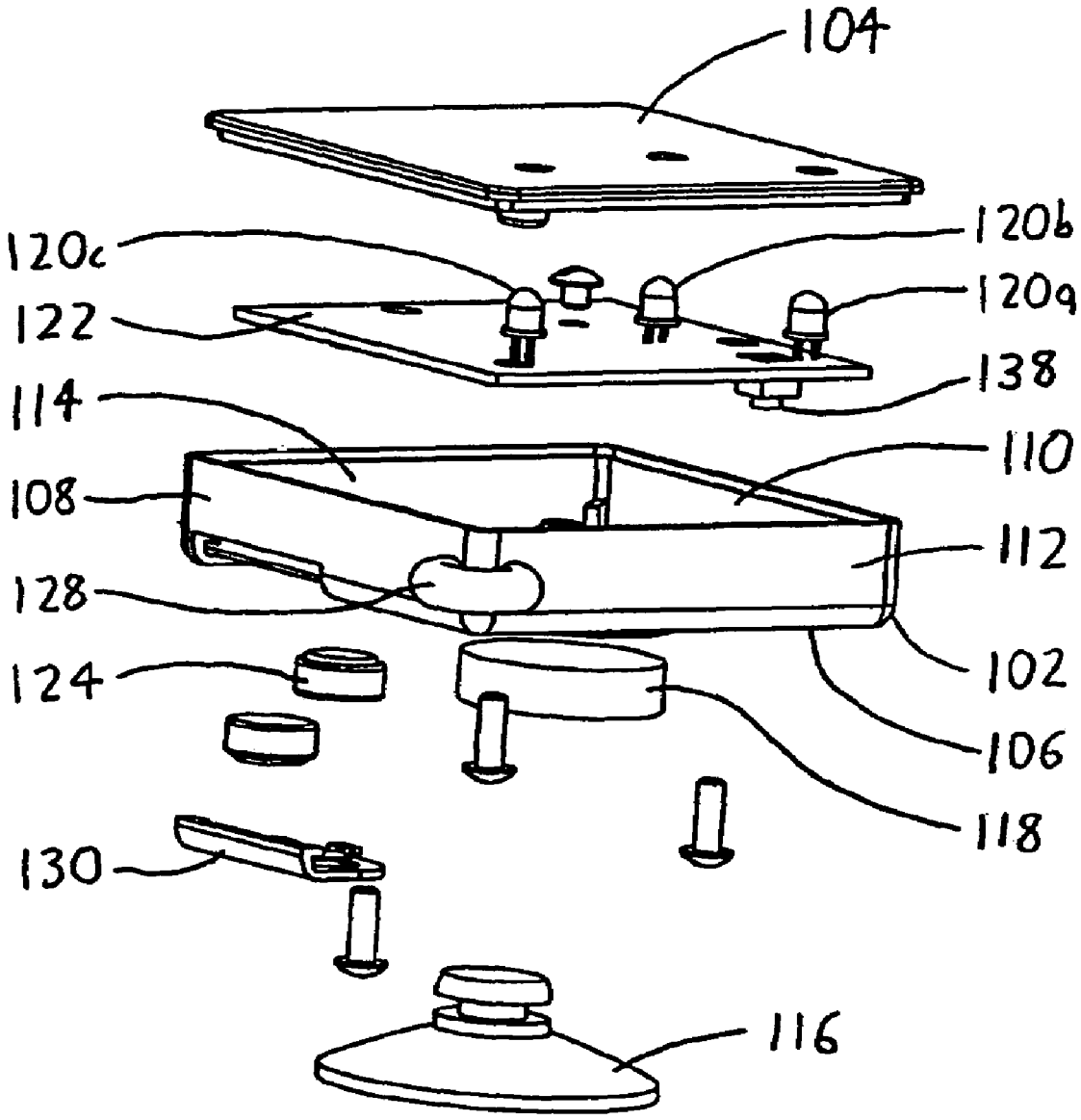
FIG. 3 is a front exploded perspective view of the signal light 100.

Second, while the signal light 100 is depicted in FIG. 3 as including LEDs 120 mounted in a fixed configuration on the powering circuit 122, and with the LEDs 120 then protruding through the front face 104 of the casing 102, it is also (or instead) possible to have the front face 104 at least partially formed of transparent material so that LEDs 120 mounted below the front face 104 are visible through the front face 104, and for LEDs 120 to be mounted in selected sockets/terminals or other desired locations on the powering circuit 122. If the powering circuit 122 contains empty sockets spaced about its surface into which LEDs may be inserted in conductive relationship, the layout of the LEDs 120 may be varied, and further individualized to provide a unique illumination signature for particular service providers.

Third, while it is generally expected that the reconfiguration means will limit the signal light 100 to a single unique illumination signature when the signal light 100 is provided to consumers, it is also possible that the signal light 100 might include more than one unique illumination signature, and may be switched between the different signatures—for example, it may have one signature intended to signal paramedic services, another signature intended to signal police services, etc. An additional switch might be included to effect such switching, or the switch 126 might allow such switching (e.g., press once to effect a first signature, twice to effect a second signature, etc., press for an extended period to turn off, etc.).

Fourth, other means for mounting the signal light 100 to a door or other surface might be provided apart from the suction cup 116, magnet 118, and lanyard 128 noted earlier, such as cooperating hook-and-loop fasteners, double-sided tape, hooks/clips, and the like. The lanyard 128 may itself receive a hanging peg (e.g., a nail) protruding from a surface, or it may bear a hook or the like for hanging purposes. The suction cup 116 and magnet 118 (and to some degree the lanyard 128) represent a particularly preferred arrangement, since they allow the signal light 100 to readily adhere to a common refrigerator (which is a particularly preferred storage location), and to a common exterior door or window.

What is claimed is:

1. A signal light comprising:

a. a casing having a front face, an opposing rear face, and sidewalls extending therebetween, wherein the casing has:

(1) a width dimension measured between opposing sidewalls;

(2) a height dimension measured between opposing sidewalls perpendicularly to the width dimension; and (3) a thickness dimension measured between its front and rear faces, the thickness dimension being less than each of the width and height dimensions;

b. two or more LEDs spaced about the front face of the casing, wherein at least two of the LEDs are spaced apart by a distance at least as great as approximately one-half of the greater of:

(1) the width dimension, and (2) the height dimension;

c. one or more batteries enclosed within the casing;

d. a switch on the casing;

e. a powering circuit supplying power from the batteries to the LEDs when the switch is activated, the powering circuit causing at least one of the LEDs to be illuminated at a frequency of greater than 0.5 Hz;

f. mounting means affixed to the casing for mounting the signal light to a surface.

2. The signal light of claim 1 wherein the powering circuit includes reconfiguration means for allowing a change in the frequency at which at least one of the LEDs is illuminated.

3. The signal light of claim 2 wherein the reconfiguration means includes an electronic memory storing LED illumination instructions therein.

4. The signal light of claim 1 wherein the thickness dimension of the casing is less than or equal to 0.75 inches.

5. The signal light of claim 1 wherein the casing has a front face area of less than 8 square inches.

6. The signal light of claim 1 further comprising one or more button cell batteries powering the LEDs, wherein the button cell batteries each have their terminals oriented in a plane at least substantially parallel to the front face of the casing.

7. The signal light of claim 1 wherein at least two of the LEDs are each illuminated:

a. at a frequency of greater than 0.5 Hz, and b. at different times.

8. The signal light of claim 1 wherein the mounting means includes both a suction cup and a magnet, and wherein:

a. the suction cup is flexible and protrudes outwardly from the casing past the magnet, and b. pressing the suction cup against a surface brings the magnet against the surface.

9. The signal light of claim 1 wherein a major portion of the front face of the casing is at least substiantally opaque, whereby the opaque portion may bear indicia printed or adhered thereon without obscuring an adjacent one of the LEDs.

10. The signal light of claim 1 wherein at least a portion of the front face of the casing adjacent the LEDs is at least substantially opaque, and bears the name of a service provider thereon.

11. The signal light of claim 1 wherein the front face of the casing bears the name and telephone number of a service provider.

12. A signal light comprising:

a. a casing having a front face, an opposing rear face, and sidewalls extending therebetween, wherein the thickness dimension of the casing as measured between its front and rear faces is smaller than the width or height dimensions measured between opposing points on the sidewalls;

b. three or more LEDs on the front face of the casing;

c. one or more batteries enclosed within the casing;

d. a switch on the casing;

e. a powering circuit supplying power from the batteries to the LEDs when the switch is activated, the powering circuit including reconfiguration means for allowing a change in the frequency at which one or more of the LEDs is illuminated;

f. at least one of:

(1) a suction cup, and (2) a magnet, affixed to the casing.

13. The signal light of claim 12 wherein the casing has a thickness which is less than or equal to half of the greater of its width or height.

14. The signal light of claim 13 further comprising one or more button cell batteries powering the LEDs, wherein the button cell batteries each have their terminals oriented in a plane at least substantially parallel to the front face of the casing.

15. The signal light of claim 12 further comprising one or more button cell batteries powering the LEDs.

16. The signal light of claim 12 wherein at least one of the LEDs is illuminated at a frequency of greater than 0.5 Hz.

17. The signal light of claim 12 wherein at least two of the LEDs are each illuminated:

a. at a frequency of greater than 0.5 Hz, and b. at different times.

18. The signal light of claim 12 wherein at least two of the LEDs are spaced apart by a distance at least as great as approximately one-half of the greater of:

a. the width dimension, and b. the height dimension.

19. The signal light of claim 12 wherein at least one of the LEDS does not rest along a line defined by two of the other LEDs.

20. The signal light of claim 12 wherein the casing has a thickness of less than 0.75 inches.

21. The signal light of claim 12 wherein the front face of the casing has an area of less than 8 square inches.

22. The signal light of claim 12 wherein the reconfiguration means includes an electronic memory storing LED illumination instructions therein.

23. The signal light of claim 12 wherein the casing includes both a suction cup and a magnet, and wherein:

a. the suction cup is flexible and protrudes outwardly from the casing past the magnet, and b. pressing the suction cup against a surface brings the magnet against the surface.

24. The signal light of claim 12 wherein the casing bears the name and telephone number of a service provider thereon.

25. A signal light comprising:

a. a casing having a front face, an opposing rear face, and sidewalls extending therebetween, wherein the thickness dimension of the casing as measured between its front and rear faces is smaller than the width or height dimensions measured between opposing points on the sidewalls;

b. two or more LEDs spaced about the front face of the casing;

c. one or more batteries enclosed within the casing;

d. a powering circuit supplying power from the batteries to the LEDs when the switch is activated, the powering circuit causing at least one of the LEDs to be illuminated at a frequency of greater than 0.5 Hz;

e. a magnet affixed to the casing, and f. a suction cup:

(1) affixed to the casing, and (2) fixed adjacent to the magnet and extending outwardly past the magnet, wherein pressing the suction cup against a surface brings the magnet against the surface.

26. The signal light of claim 25 further comprising one or more button cell batteries powering the LEDs.

27. The signal light of claim 25 further comprising one or more button cell batteries powering the LEDs, wherein the button cell batteries each have their terminals oriented in a plane at least substantially parallel to the front face of the casing.

28. The signal light of claim 25 wherein at least two of the LEDs are each illuminated:

a. at a frequency of greater than 0.5 Hz, and b. at different times.

29. The signal light of claim 25 wherein at least two of the LEDs are spaced apart by a distance at least as great as approximately one-half of the greater of:

a. a width dimension measured between opposing sidewalls, and b. a height dimension measured between opposing sidewalls perpendicularly to the width dimension.

30. The signal light of claim 25 wherein the powering circuit includes reconfiguration means for allowing a change in the frequency at which at least one of the LEDs is illuminated.

31. The signal light of claim 30 wherein the reconfiguration means includes an electronic memory storing LED illumination instructions therein.

32. The signal light of claim 25 wherein the casing bears the name and telephone number of a service provider thereon.

33. The signal light of claim 25 wherein the front face of the casing has an area of less than 8 square inches.

34. The signal light of claim 25 wherein the casing has a thickness of less than or equal to 0.75 inches.

* * * * *